US006749500B1

(12) United States Patent
Nelson et al.

(10) Patent No.: US 6,749,500 B1
(45) Date of Patent: Jun. 15, 2004

(54) SIMULATED POKER FOR USE WITH PREDETERMINED OUTCOMES

(75) Inventors: Loren Travis Nelson, Reno, NV (US); Dimo Dinkov Ditchev, Reno, NV (US); Russ Frederick Marsden, Gardnerville, NV (US)

(73) Assignee: Sierra Design Group, Reno, NV (US)

( * ) Notice: Subject to any disclaimer, the term of this patent is extended or adjusted under 35 U.S.C. 154(b) by 15 days.

(21) Appl. No.: 09/912,797

(22) Filed: Jul. 23, 2001

(51) Int. Cl.[7] ..... A63F 9/24
(52) U.S. Cl. ..... 463/13; 463/16
(58) Field of Search ..... 463/12–13, 16–22, 463/25–28, 30–32, 37; 273/138.1, 139, 292, 274

(56) References Cited

U.S. PATENT DOCUMENTS 5,019,973 A * 5/1991 Wilcox et al. ..... 463/13
5,489,101 A 2/1996 Moody
5,531,440 A * 7/1996 Dabrowski et al. ..... 463/12
5,833,536 A 11/1998 Davids
5,851,148 A 12/1998 Brune
5,853,325 A 12/1998 Kadlic
5,947,821 A * 9/1999 Stone ..... 463/13
5,971,849 A 10/1999 Falciglia
5,984,779 A * 11/1999 Bridgeman et al. ..... 463/16
6,062,981 A 5/2000 Luciano
6,098,985 A 8/2000 Moody
6,110,040 A 8/2000 Sanduski
6,131,907 A 10/2000 Nucifora
6,132,311 A 10/2000 Williams
6,146,271 A 11/2000 Kadlic
6,149,521 A 11/2000 Sanduski
6,227,969 B1 * 5/2001 Yoseloff ..... 463/13

* cited by examiner

*Primary Examiner*—Kim Nguyen
(74) *Attorney, Agent, or Firm*—Russ F. Marsden

(57) ABSTRACT

A system and method for presenting a player with simulated poker play is disclosed, where the result is actually based on a predetermined outcome. In order to create a realistic play scenario, the present invention never corrects or overrides a player's choices during the play of a hand. Rather, a new solution which incorporates a specially indicated, separately drawn card is used. If a player makes choices while playing a hand that precludes the game machine from creating a final hand having a value equivalent to the predetermined amount of a win, a separate card from those in the hand is used to create a bonus award that makes up any difference. In addition, the way in which the separate card is implemented includes the issuance of seemingly random bonus awards, allowing both good and poor poker players to receive such bonuses. This further increases the realism of the play.

38 Claims, 2 Drawing Sheets

Game Device
For Modified Poker Play

Method For Using A Specially Designated Match Card To Create Required Outcomes While Maintaining Player Choice In Poker

SIMULATED POKER FOR USE WITH PREDETERMINED OUTCOMES

BACKGROUND OF THE INVENTION

1. Field of the Invention

This invention pertains generally to gaming systems. More particularly, the present invention relates to a method and apparatus for providing the appearance to players of playing an actual poker hand, while playing a game where the actual outcome is predetermined.

2. The Prior Art

Fixed pool games are well known, often forming the basis of many games used by many state and private lotteries. A fixed pool game is one in which a specified amount of money or prizes (the prizes having calculable monetary equivalents) are distributed into a set of individually purchasable and winnable units, where each individual unit has a known cost, and where the set further includes purchasable units having no prize. Thus, the total amount of prizes, the prize distribution (i.e., the number of prizes at each level), and the total return if all individually purchasable units are sold are known at the game's outset.

The individually purchasable units are typically generated and distributed as tickets. The two most common form of tickets are pull tab tickets, called pulltabs, and scratch-off tickets, called scratchers. Pull tab tickets are typically constructed from paper of various thickness, having two layers. The first layer has some type of indication of the purchasers' winnings, if any, and the second layer covers the first. The second layer is typically glued to the first layer around three edges, covering the results. The fourth edge typically has a small tab, allowing the purchaser to grab hold of it. The tab, upon being pulled, pulls the layers apart and reveals the purchasers' winnings, if any. Scratchers use an opaque material that covers portions of the ticket, where the covered portions have the predetermined results on them. The purchaser scrapes off the opaque material, revealing any winnings.

The distribution of the total winnings, coupled with the cost of each individually purchasable unit, is determined by those making up the game. The exact mechanics and mathematics of each game pool depends on the goals of the issuer, including the target play audience (how much to charge per purchasable unit or ticket or play), the desired return on investment, and size of the pool, as well as other considerations as are well known in the art. The tickets (individually purchasable units) for the entire game are then printed and distributed, usually organized into decks with different decks sold to different locations. Players, by purchasing a ticket, are buying one individually purchasable unit from the overall ticket or game event pool.

This is may be referred to as a fixed-pool lottery, meaning there is a fixed pool of tickets (or results) having a predetermined number of winners and losers, and a purchaser takes a chance on getting a winning result by entering the "lottery", meaning taking the chance they will by a winning ticket from the pool.

To make the results more interesting to a player, fixed-pool lottery based games have been recently been displayed in many ways. One particular representation is as a poker hand, attempting to mimic actual poker play.

The player bets a certain amount to play the game. This corresponds to an individually purchasable unit (note that different betting amounts may participate in different fixed-pool lotteries) for the lottery being used. The game will typically get the result of a random drawing from a central server or location having several operating pools. The result is sent back to the game machine. The game machine then represents the results in as a game.

Up to the present time, game machines using fixed-pool lotteries which have attempted to represent the predetermined winning amount by mimicking poker play have had significant limitations. In particular, the prior art machines would present the player with a 5 cards (mimicking a hand), and the player would indicate which cards to hold, where any not held are discarded. If the player is either not a good poker player or is going for long odds, if is likely they will discard cards that were needed to make up the predetermined winning hand.

For example, suppose the predetermined award required the player to end up with a full house and the player's initial hand had two pair. If the player discards one from pair, leaving three unrelated cards, a full house cannot be created with the new draw. The prior art game overrides the player's hold choices and discards the "correct" cards, resulting in a new hand having a full house.

The action of overriding a player's choices completely ruins the intended purpose of the game, which is to produced the illusion of true poker play. Thus, there is a need to have a game, based on the use of fixed-pool lotteries, that can better mimic true poker play from a player's perspective.

BRIEF DESCRIPTION OF THE INVENTION

The present invention discloses a new method and apparatus to allow very realistic display of a fixed-pool game result as a poker hand. Unlike previous games which overrode or restricted a player's choice of play with respect to some cards in the initial hand, the present invention allows the player to make any play consistent with the rules and allowable interactions of the specific poker-like game being played. In one embodiment using a game play based on five card draw, the allowable interactions are made up of choosing which cards to hold and which to discard.

If a player makes poor decisions, or tries to play a long shot (as if they were playing real poker), the result can be a set of cards that no longer allows the game to represent the predetermined winning amount, regardless of what cards are used to replace those that were discarded. In this case use is made of a special card illustrated on the games display called a match card. The match card is a card that is not part of the player's hand (the in-hand set of cards) and is under the control of the game. The match card appears to a player like a randomly drawn card originating from another deck, where a bonus is won if the apparently randomly drawn card matches the in-hand card to which it is associated. "Associated" is explained further below, but means there is one of the in-hand cards that is somehow visually connected to the match card. If the two cards are shown as matching, in a preferred embodiment "matching" means having the same suit and value, a bonus award is made.

When a player plays their cards such that the already predetermined amount of winnings cannot be shown on the screen, the match card is used by showing a match with one of the in-hand cards, showing a visual association between the two, and then awarding the needed amounts of points (bonus winnings) to create an overall play total equaling the predetermined amount of winnings.

This appears to the player as an extra bonus aspect of the game not associated with the play of a poker hand, thus furthering the appearance of playing real poker.

DETAILED DESCRIPTION OF THE PREFERRED EMBODIMENTS

Persons of ordinary skill in the art will realize that the following description of the present invention is illustrative only and not in any way limiting. Other embodiments of the invention will readily suggest themselves to such skilled persons having the benefit of this disclosure.

Figure 1:
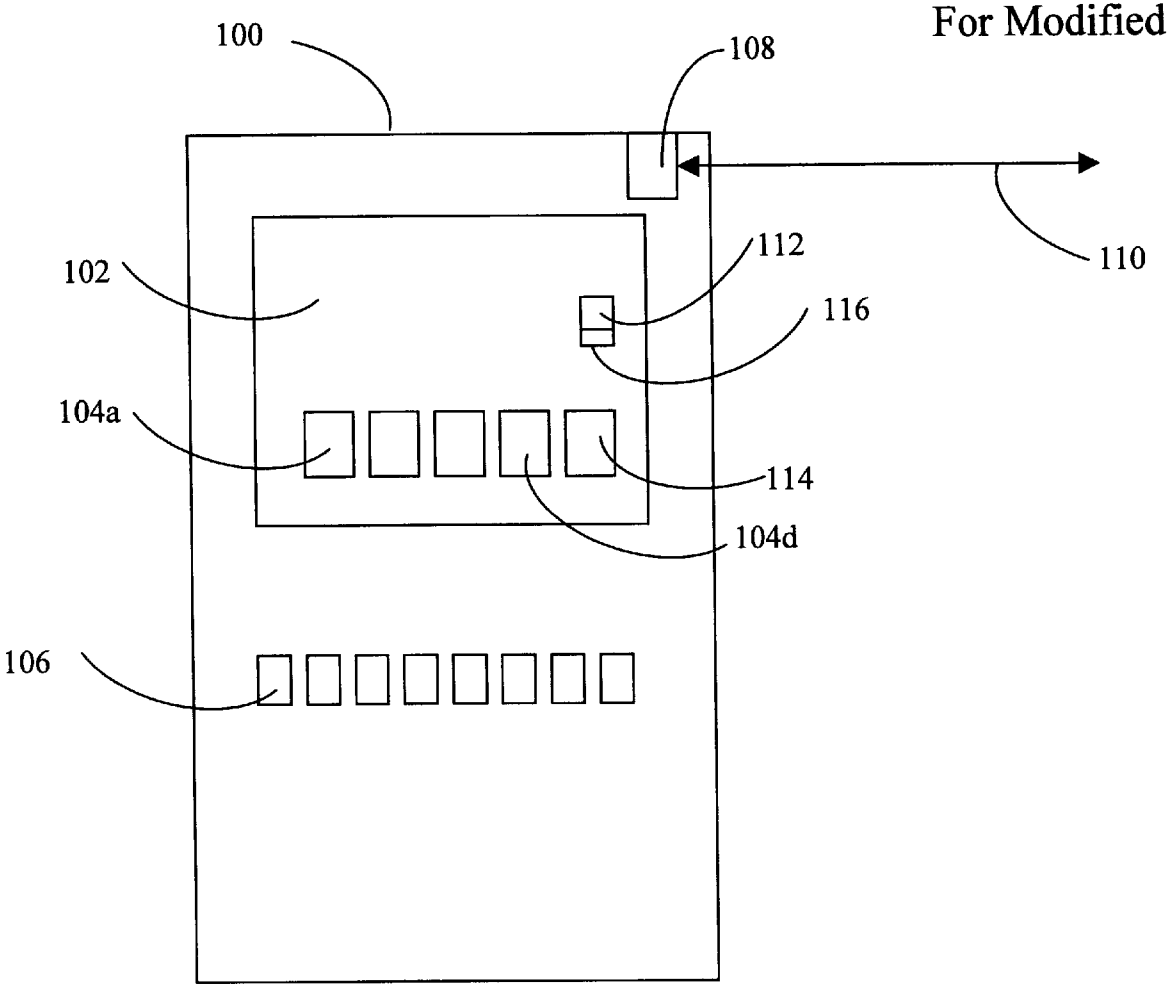
FIG. 1 is a functional block diagram of an example game device in accordance with the present invention.
Figure 2:
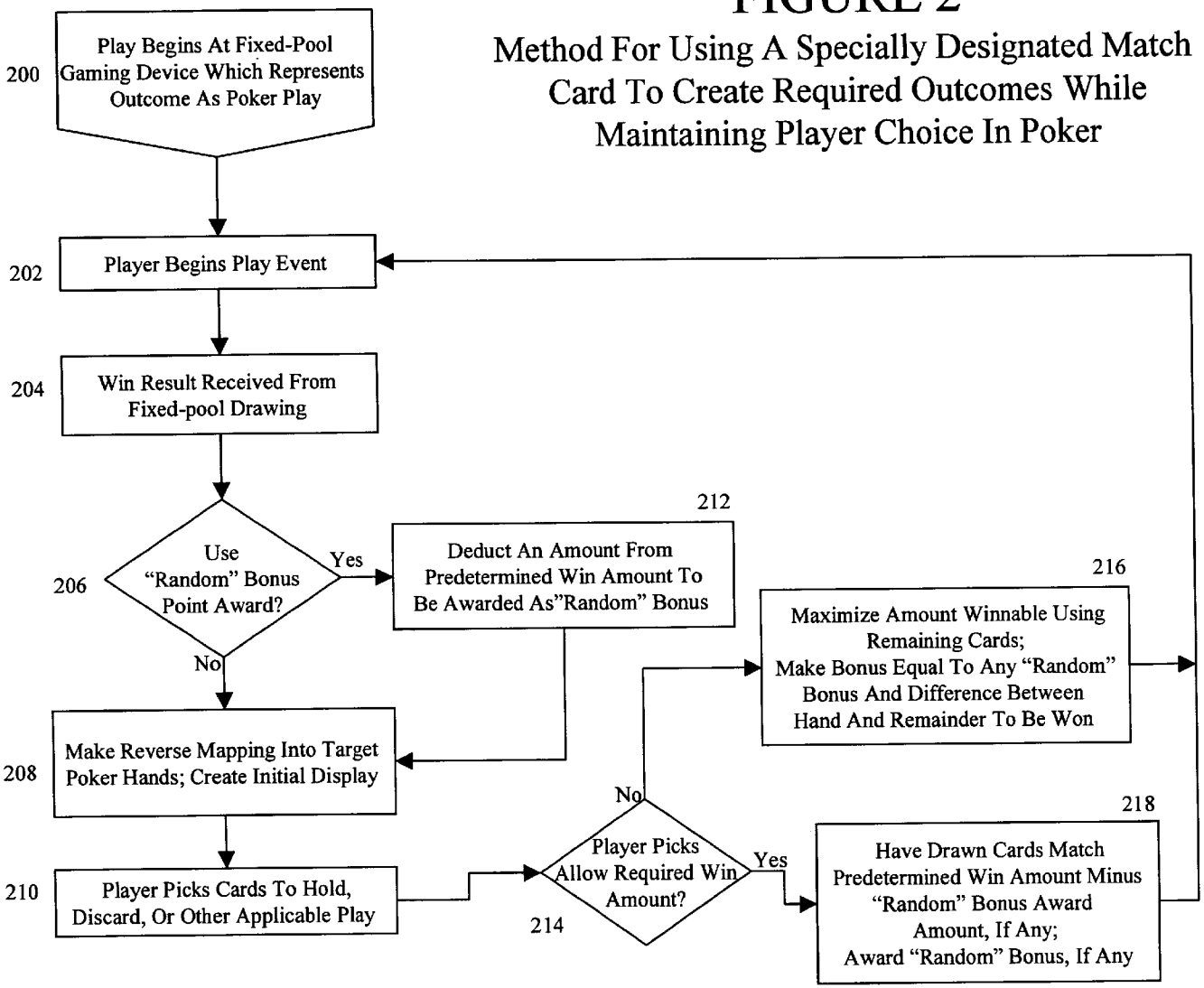
FIG. 2 is a flow diagram illustrating simulated game play in accordance with the present invention.

Referring to the drawings, for illustrative purposes the present invention is shown embodied in FIGS. 1 and 2. It will be appreciated that the apparatus may vary as to configuration and as to details of the parts, and that the method may vary as to details, partitioning, and the order of the acts, without departing from the inventive concepts disclosed herein.

FIG. 1 shows a game device according to the present invention. The game device has a cabinet 100 enclosing a video display 102 and a set of standard game play buttons shown generally as buttons 106. The game device also comprises the internal hardware and software needed for gaming devices, including at least one processor, dynamic memory, non-volatile memory, system support circuitry such that an embedded operating system will rum properly, and I/O connections including interfaces to the various player interfaces such as play buttons 106 and video 102 output, and an interface to an external network connection shown as SMIB (slot machine interface board) 108. Also included is the software needed to implement the specific game. The internals are not illustrated. SMIB 108 interfaces with a network connection 110, typically to an RGC (remote game controller, not shown).

In addition to many features that are typical to a game device and not illustrated such as various glass art, the new and unique addition to poker game play in a fixed-pool lottery based environment is shown. It was discovered that by using an addition specially designated card, shown as card 112, over and above the cards that comprise a traditional poker hand, very realistic play may be achieved. The additional card will be referred to as a "match card" for the purposes of this disclosure, and "in-hand" refers to the cards that comprise a poker hand. The actual number of cards in-hand varies depending on the type of poker being played or used. Illustrated is five card draw poker, having five cards in-hand, shown as cards 104*a* through 104*d* and card 114. The realistic play may be achieved without regard to any mistakes, bad play, or long shot holds and draws a player may decide to use.

Match card 112 is shown placed above one of the in-hand cards, card 114. In one embodiment, this physical placement corresponds to the card association that indicates which two cards must match if bonus points are to awarded. Match card 112 is left illustrated on the video screen as an upside down card, only showing a pattern on the reverse side, until the player is shown a hand, makes hold decisions, and the discarded cards replaced. Simultaneously with, or shortly after, the discards are shown as replaced with "new" cards, match card 112 is shown as turned onto its obverse. In this implementation, match card 112 and the card shown in position 114 must be the same card for a bonus event to occur (these two cards comprise associated cards, indicated by their relative physical position on screen 102). If they show as the same card, a bonus is displayed in bonus window 116, which is added to the player's overall game credits or score.

As used in this disclosure, "same card" is defined to mean that two cards have the same suit and value showing on their obverse sides. "Matched card", "matching card", and "match card" are used in this disclosure to mean two cards having the same suit, the same value, the same suit and value, or being two "related cards." "Related cards" is defined to mean two cards related by explicit rules of the game other than suit and face value. An example of "related cards" is a game where a bonus is awarded if the bonus card has twice the value of the in-hand card, such as the bonus being a ten of diamonds and the in-hand card to which it is associated is a five of diamonds. Thus, examples of "matched cards" includes "same cards" such as both cards being a queen of diamond, same suit cards such as a two and a ten of clubs, same value cards such as a three of spades and a three of hearts, and any two cards related by the rules of a particular game. Each particular game implementation will make clear which cards match; the present invention works equally well with all these definitions.

In one preferred embodiment, match card 112 is implemented as an image (on a video screen) having a different size, physically, from the in-hand cards 104 through 104*d* and 114. This helps distinguish the two types of cards, visually, for the player. Match card 112 is designed to be visually suggestive of a random card drawn from a different deck than the in-hand cards, where bonus points are awarded if the "randomly drawn" match card 112 and the card in position 114 are the same card.

A preferred embodiment using five card draw is shown in FIG. 1, however, the present invention is readily used in any of the numerous poker variations used in poker gaming machines, including but not limited to 5 and 7 card stud, Texas Hold'em, the various three-card and more in-hand card games found in some poker variations, and the any of the multi-line and multi-hand poker variations. The present invention is used by having a player select a poker game to play by selecting one of a plurality of poker games offered on a single game machine, or selecting a poker game machine having the poker game the player desires to play, where each individual in-hand card set (perhaps represented by a pay line in a card matrix, for example, as well as the traditional line of cards) is associated with a match card. Note that a single match card may be associated with more than one in-hand card set, although there must be at least one match card associated with each playable in-hand set of cards.

Another variation is to make the link between a match card and the in-hand card be dynamic. Such a dynamic link may be implemented in many ways. One implementation is to have the match card appear to "travel" across the top of a screen, just above the in-hand card set. The match card may be shown as moving across the tops of the in-hand card sets, or alternatively "flashing" from location to another, finally stopping above the in-hand card which must be a match for the player to get bonus points. Apparent skill may be added in many ways, one in particular being to have the moving or traveling show its obverse after a player has otherwise finished play of the standard game, but before the traveling match card stops moving. A "stop" button is available to the player, its apparent function being to stop the moving match card in a preferred position (above a matching in-hand). The player then hits the "stop" button in an attempt to have the moving card stop in a bonus position.

Another dynamic link implementation would keep the match card stationary, but have the appearance of lines, dashes, lightening bolts, or other interesting forms represent the link. The link forms a visible association between the match card and an in-hand card, the associated cards indicating a bonus if the cards match. The link is then shown as dynamic, where the dynamic aspect comprises flashing or apparently moving links. The link them stops at the final match selection, and if the match card and in-hand match, the player wins a bonus. Like the traveling match card above, the dynamic can be implemented as an apparent skill game by having a "stop" button that has the apparent affect of being able to stop the moving or flashing link, allowing the player to attempt to have the link connecting a match card with a like-valued in-hand card.

A further dynamic link is to have a display where a match card and a set of in-hand cards have fixed relative locations, and where the "link" is shown by bright same-color borders around the match card and one of the in-hand cards, or by having the image of the two cards be brought up in intensity so they stand out from the others. This may be a better solution if the display has several in-hand card sets on display (corresponding to multiple poker hands being played simultaneously, where a player chooses, before simulated poker game play starts, a number of simultaneous poker hands to play, or a plurality of poker hands are automatically presented to the player) and several match cards being displayed. Having lines connecting different cards may be too visually confusing with multiple card sets and multiple match cards all being displayed at once. With multiple displays, a corresponding match card and in-hand card could be visually separated from each other by using different colored borders for each pair, or having each pair show an intensified, color-cued and color-hued image. If the borders or other color-based highlights are made to appear to "move" down the line of in-hand cards, an apparent skill game may be implemented by allowing the player to hit a stop button when the currently highlighted card matches the match card with the same hue.

Referring now to FIG. 2, a player begins play at a game device where the underlying game results are derived from a fixed-pool lottery at box 200. The player initiates a game play event, moving to box 202. A game play event is any action or actions (such as choosing bet amounts and then hitting a "play" button) by a player that results in game play be started. Upon the occurrence of a game initiation event, box 202 is left and box 204 entered.

The actions corresponding to box 204 are the game device communicating to a backend machine on which an applicable fixed-pool lottery game is being run. The game device appropriately signals the backend for a game result, and a result is sent back to the game device. The game device now knows the amount of winnings a player must be awarded by the end of the play sequence (hand) about to be started.

As used in this disclosure, a "play sequence" means a sequence of events starting after the game device has a known, predetermined amount of winnings (including 0 winnings) to be displayed, credited, and/or otherwise awarded to a player upon the termination of the sequence and the game device has presented the player with an initial set of cards, through any and all player interactions, to the state of the game device where the aforementioned predetermined amount of winnings has a visible display showing the player has been awarded or otherwise given the predetermined mount of winnings.

"Player interactions" or "player interaction" includes any and all player use of the game that are in accordance with the general type of poker being simulated coupled with the rules of the particular implementation. In one preferred embodiment, there is a five card hand shown to the player, and the player interaction consists of choosing which cards to hold, with any cards not held being replaced with new cards. In this preferred embodiment the player may hold from 0 to 5 cards. The player may change their mind as much as they prefer until the player indicates to the game device the player is ready for the replacement cards. This is usually accomplished by touching a "deal" or "play" button. Once the play button is touched, the game device no longer accepts player input for card choice, and the play sequence finishes.

Action proceeds to diamond 206, where a decision is made on having a "random" bonus prize appear to the player.

The word random is in quotes as the actual implementation of this event may be entirely calculated or may be partially based on a random event. The random aspect being referred to here is from the player's perspective. To make the bonus awards appear to be a true bonus rather than as only as a crutch for poor player choices, there needs to be awards made even when a player makes all the correct plays all the time. Otherwise, a regular player would notice that by making correct hold and play choices they never win a bonus, whereas the really poor poker player next to them gets bonuses on a regular basis. To prevent this, a portion of the total game credit awards (or other form of winnings) won as a result of the fixed-pool lottery drawing must be given to players as a bonus, as well as a result of the apparent poker play. To accomplish this, a portion of the net amount to be awarded in any given hand is apportioned off to be awarded as a bonus award, so that even if the player plays the poker hand correctly and therefore "wins" the max amount, some will still appear as a bonus. The result is that good poker players will see a regular occurrence of bonus awards as well as poor players, preventing the match card bonus from appearing as a "poor play fix" and making the predetermined nature of the play more obvious.

The word "winnings" is used in this disclosure to mean any form or type of winnable item found on any type of game device. This may be game credits, award credits, savable game states corresponding to some form of value associated with game play, cash, vouchers, tickets, tokens, fixed-value prizes, and any other form of winnable unit that may be used in a game device. A "winning amount" or "winnings amount" is used to mean some number of the winnable units.

Based on an algorithm of choice by the game implementers, the decision is made to either take a portion of the predetermined amount from the total and use it as a bonus (only) award or not. Note that if there are no winnings associated with this play, the answer is clearly "No". If there is a winning associated with this play, and if the answer is "Yes" (a bonus-only portion of the predetermined amount is to be set aside), then the "yes" exit is taken to box 212.

The actions corresponding to box 212 include the actions of first determining the amount to used for the bonus-only award, and deducting that amount from total amount to be awarded Note that a "a portion" of the predetermined amount may include the entire amount. This will be part of the decision made in box 212. In such a case the entire winnings will be presented to the player in the form of a bonus award. In all cases, the amount to be used as a bonus award is deducted from amount to be used in determining the outcome of the impending poker play. Box 212 is left and box 208 is entered.

Returning briefly to diamond 206, if there is to be no bonus-award only portion of the winnings, the "No" exit is taken to box 208.

Continuing with box 208, the game device makes a reverse mapping of the award points into applicable poker hands, in accordance with the variant of poker being played, the bet amounts, etc. The initial poker hand is a hand that can be used as an interim hand to the desired (by the game device) hand, with the right player choices. Box 208 is left and box 210 entered, where the player interacts with the game in a manner consistent with the type of poker being played. In one preferred embodiment this is five card draw, where a player indicates which cards they will hold. Box 210 is left and diamond 214 entered.

The decision in diamond 214 is based on the actions the player took. If the player chose the correct actions thereby allowing the game device to create the final hand needed (corresponding to the pre-selected award amount minus any subtracted award-only bonus amount), then the "Yes" exit would be taken to box 218. Otherwise the "No" exit would be taken to box 216. Proceeding along the path that corresponds to a correct play choice by the player, the "Yes" exit is taken to box 218.

The actions corresponding to box 218 are to show the final hand (not changing any of the choices the player made), corresponding to the total award amount minus any bonus-only award amount (if any). The player has "won" an amount corresponding to the final set of in-hand cards. The game device now reveals the match card associated with an in-hand card to produce the needed results (this covers any implementation, including but not limited to a fixed-position match card, a color-coded match card, a movable match card, or a dynamic link). If the match card and its associated card are a match ("match" as defined above), then the player is awarded bonus points. In this case, the player will be awarded bonus points only if some bonus-only points (or other awardable equivalents) were deducted from the total amount to be won this hand, in which case the player is now awarded those bonus-only points. Adding the bonus award winnings (amounts) and the in-hand card set winnings (amounts) always equals the predetermined winnings (amounts) the game device received from a backend machine at the start of play.

Proceeding from box 218, the game is now ready to play again and process continues at box 202 when the player initiates a game play event again. The loop will continue as long as the player is using the game device.

Returning to diamond 214, if the player made bad card and play choices, meaning that a hand comprising some set of cards needed to show a win of the amount to be awarded can no longer be created using the player's remaining cards, the "No" exit is taken to box 216. An quick example of such a situation is a five card draw poker machine where the amount to be awarded to a player corresponds to a hand having a full-house. The initial cards shown to the player are two pair and a singleton. The player discards one from each pair. A full house can no longer be made from the remaining cards in the players' hand, corresponding to proceeding to box 216. Diamond 214 is left and box 216 entered.

The actions corresponding to box 216 include having the game device create a hand having a portion of the amount that was to have been awarded (won), where a portion includes the possibility of making no award (it may not be possible, depending on what the player did). The balance still due the player is then added to the bonus-only amount and the sum awarded through the use of the match card. This is done by having the match card be a match with, and associated with, an in-hand card. The player has now won the total amount that was to be have won in this hand through the use of both the hand itself and the bonus award associated with the match card. In no case has the player's card choices been altered. Box 216 is left and the process will continue with box 202 when a game initiation event occurs.

The present invention has been partially described using a flow diagram. As will be understood by a person of ordinary skill in the art and with the benefit of the present disclosure, steps described in the flow diagram can vary as to order, content, allocation of resources between steps, times repeated, and similar variations while staying fully within the inventive concepts disclosed herein.

Accordingly, it will be seen that this invention provides a system and method for providing the appearance of true poker play, when the game is in fact representing a predetermined outcome based on the result of a drawing from a fixed-pool lottery type game. This is accomplished with the use of a special card called a match card, where the match card, coupled with a bonus, is used to make up any player choice deficiencies when such deficiencies prevent the awarding of the predetermined winnings. This completely avoids the problems found in the prior art, when a player's bad choices are overridden by the machine. A player's choice is never overridden or changed using the present invention, giving the appearance of real poker play. Although the description above contains certain specificity, the described embodiments should not be construed indicating the scope of the invention; the descriptions given are merely providing an illustration of embodiments of the invention. The scope of this invention is determined by the appended claims and their legal equivalents.

What is claimed is:

1. A method for simulating poker play on a game device, where the type of poker to be simulated is known at the start of a play sequence and where said type of poker has a defined set of player interactions, and where a predetermined winning amount having a 0 or greater value is associated with the play sequence and is known at the start of the play sequence, and where the game device provides a match card associable with an in-hand card, the method comprising:

(a) showing an initial set of cards comprising an initial hand in accordance with said type of poker game and in accordance with said predetermined winning amount;

(b) allowing player interaction with said game device where said player interactions are in accordance with said type of poker and its defined player interactions;

(c) having said game device not unilaterally change any of said allowed player interactions;

(d) determining a final set of cards in accordance with said initial set of cards and said player interactions, and further having a value less than or equal to said predetermined winning amount, said value being a final hand amount;

(e) calculating a difference between said predetermined winning amount and said final hand amount, said difference being a bonus amount;

(f) making said determined final set of cards visible to a player; and, (g) associating said match card with said in-hand card, where said match card and said in-hand card are shown in an associated manner, and further shown as one of: matched cards having a value comprising said bonus amount if said bonus amount is not 0; or, unmatched cards having no value if said bonus amount is 0.

2. The method of claim 1 further comprising associating said match card with said in-hand card, where said match card and said in-hand card are not matched cards, shown in an associated manner, and where a bonus is one of: not shown; or, shown as having no value, if said bonus amount is 0.

3. The method of claim 1 where said poker type is five card draw, and said defined player interactions comprise holding one of: any, some, or none of said initial set of cards.

4. The method of claim 1 where said associating said match card with said in-hand card further comprises having said match card move on a screen in a manner visible to said player and stop in a manner that visually associates said match card and said in-hand card.

5. The method of claim 4 where said associating said match card with said in-hand card further comprises allowing said player to interactively enter a stop request after said match card is moving and before said match card stops moving, and where said moving match card further stops moving as quickly as possible after said game device receives said stop request and in a manner visually associated said match card with said in-hand card consistent with said bonus winning amount.

6. The method of claim 1 where said associating said match card with said in-hand card further comprises having a moveable element on a screen visible to said player having a first end and a second end connected by a visible connector portion, where said first end is in visual association with said match card and said second end and said connector portion move on said screen and then stop moving such that said second end is in visible association with said in-hand card.

7. The method of claim 6 where said associating said match card with said in-hand card further comprises allowing said player to interactively enter a stop request after said second end is moving and before said second end stops moving, and where said second end further stops moving as quickly as possible after said game device receives said stop request and in a manner visually associated said second end with said in-hand card consistent with said bonus winning amount.

8. The method of claim 1 where associating said match card with said in-hand card further comprises creating a same visual change to both said match card and said in-hand card where said visual change comprising one of: a color-based change; an intensity-based change; a hue-based change; or, a combination of color, hue and intensity change.

9. The method of claim 8 where said associating said match card with said in-hand card further comprises allowing said player to interactively enter a stop request after said visual change is shown with said match card and while a similar visual change is being applied to said in-hand cards, one at a time and moving from one in-hand card to another, before said visual changes stop, and where said visual changes stop as quickly as possible after said game device receives said stop request and in a manner where said visually changed in-hand card and said same visually changed match card are consistent with said bonus winning amount.

10. The method of claim 1 where associating said match card with said in-hand card further comprises positioning, in a fixed manner, said match card in a position that is one of: visually above; or, visually near, said in-hand card.

11. The method of claim 10 where said associated said match card with said in-hand card further comprises having a static visual connector between said cards, where the visual connector is one of: an arrow; or, a line.

12. The method of claim 1 further comprising choosing, before said simulated poker game play starts, one of a plurality of choices, said choices comprising different poker games.

13. The method of claim 1 further comprising choosing, before said simulated poker game play starts, a number of simultaneous poker hands to play.

14. A method for simulating poker play on a game device, where a type of poker to be simulated is known at the start of a play sequence and where said type of poker has a defined set of player interactions, and where a predetermined winning amount having a 0 or greater value is associated with the play sequence and is known at the start of the play sequence, and where the game device provides a match card associable with an in-hand card, the method comprising:

(a) using at least a portion of said predetermined winning amount for an initial bonus winning amount;

(b) calculating a target winning amount based on a difference between said predetermined winning amount and said initial bonus winning amount;

(c) showing an initial set of cards comprising an initial hand in accordance with said type of poker game and in accordance with said target winning amount;

(d) allowing player interaction with said game device where said player interactions are in accordance with said type of poker and its defined player interactions;

(e) having said game device not unilaterally change any of said allowed player interactions;

(f) determining a final set of cards in accordance with said initial set of cards and said player interactions, and further having a value less than or equal to said target winning amount, said value being a final hand amount;

(g) calculating a difference between said target winning amount and said final hand amount;

(h) making said determined final hand visible to a player; and, (i) associating said match card with said in-hand card, where said match card and said in-hand card are matched cards having a value comprising said difference between said target winning amount and said final hand amount and adding to said difference said initial bonus award amount.

15. The method of claim 14 further comprising associating said match card with said in-hand card, where said match card and said in-hand card are not matched cards and are shown in an associated manner, where a total bonus winning amount comprising said difference between said target winning amount and said final hand winning amount and further comprising adding to said difference said initial award bonus amount, if said total bonus winning amount is 0.

16. The method of claim 14 where said poker type is five card draw, and said defined player interactions comprise holding one of: any, some, or none of said initial set of cards.

17. The method of claim 14 where said associating said match card with said in-hand card further comprises having said match card move on a screen in a manner visible to said player and stop in a manner that visually associates said match card and said in-hand card.

18. The method of claim 17 where said associating said match card with said in-hand card further comprises allowing said player to interactively enter a stop request after said match card is moving and before said match card stops moving, and where said moving match card further stops moving as quickly as possible after said game device receives said stop request and in a manner that visually associates said match card with said in-hand card consistent with said bonus winning amount.

19. The method of claim 14 where said associating said match card with said in-hand card further comprises having a moveable element on a screen visible to said player having a first end and a second end connected by a visible connector portion, where said first end is in visual association with said match card and said second end and said connector portion move on said screen and then stop moving such that said second end is in visible association with said in-hand card.

20. The method of claim 19 where said associating said match card with said in-hand card further comprises allowing said player to interactively enter a stop request after said second end is moving and before said second end stops moving, and where said second end further stops moving as quickly as possible after said game device receives said stop request and in a manner visually associated said second end with said in-hand card consistent with said bonus winning amount.

21. The method of claim 14 where associating said match card with said in-hand card further comprises creating a same visual change both said match card and said in-hand card where said visual change comprising one of: a color-based change; an intensity-based change; a hue-based change; or, a combination of color, hue and intensity change.

22. The method of claim 21 where said associating said match card with said in-hand card further comprises allowing said player to interactively enter a stop request after said visual change is shown with said match card and while a similar visual change is being applied to said in-hand cards, one at a time and moving from one in-hand card to another, before said visual changes stop, and further where said visual changes stop as quickly as possible after said game device receives said stop request and in a manner where said visually changed in-hand card and said same visually changed match card are consistent with said bonus winning amount.

23. The method of claim 14 where associating said match card with said in-hand card further comprises positioning, in a fixed manner, said match card in a position that is one of: visually above; or, visually near, said in-hand card.

24. The method of claim 23 where said associated said match card with said in-hand card further comprises having a static visual connector between said cards, where the visual connector is one of: an arrow; or, a line.

25. The method of claim 14 further comprising choosing, before said simulated poker game play starts, one of a plurality of choices, said choices comprising different poker games.

26. The method of claim 14 further comprising choosing, before said simulated poker game play starts, a number of simultaneous poker hands to play.

27. A game device having at least one poker style game operably disposed therein and having a connection configured to be operable with at least one source useable to establish a winning amount having a 0 or greater value, comprising:

a display to a player;

at least one match card image capable of being visible to said player within said display and under operable control of said poker style game;

at least one set of in-hand card images capable of being visible to said player within said display and under operable control of said poker style game;

where said poker style game is further configured to associate said winning amount with one of said match card images and one of said set of in-hand cards images before said player is enabled to start a play sequence, and is configured to enable said player to complete a play sequence such that at the end of said play sequence said match card image and said set of in-hand card images, taken together, display a value equal to said winning amount.

28. A game device for simulating poker play, where a type of poker to be simulated is known at the start of a play sequence and where said type of poker has a defined set of player interactions, and where a predetermined winning amount having a 0 or greater value is associated with the play sequence and is known at the start of the play sequence, and where the game device provides a match card associable with an in-hand card, the game device comprising:

means for showing an initial set of cards comprising an initial hand in accordance with said type of poker game and in accordance with said predetermined winning amount;

means for allowing player interaction with said game device where said player interactions are in accordance with said type of poker and its defined player interactions;

means for determining a final set of cards in accordance with said initial set of cards and said player interactions and further having a value less than or equal to said predetermined winning amount, said value being a final hand amount;

means for calculating a difference between said predetermined winning amount and said final hand amount, said difference being a bonus amount;

means for making said determined final hand visible to a player; and, means for associating said match card with said in-hand card, where said match card and said in-hand card are shown as matched cards in an associated manner, and where a bonus is shown having a value comprising said bonus amount, if said bonus amount is not 0.

29. The game device of claim 28 further comprising means for associating said match card with said in-hand card, where said match card and said in-hand card are not matched cards, shown in an associated manner, and where said bonus is one of: not shown; or, shown as having no value, if said bonus amount is 0.

30. The game device of claim 28 where said poker type is five card draw, and said defined player interactions comprise holding one of: any, some, or none of said initial set of cards.

31. The game device of claim 28 where said associating said match card with said in-hand card further comprises means for having said match card move on a screen in a manner visible to said player and stop in a manner that visually associates said match card and said in-hand card.

32. The method of claim 31 where said associating said match card with said in-hand card further comprises a means for allowing said player to interactively enter a stop request after said match card is moving and before said match card stops moving, and where said moving match card further stops moving as quickly as possible after said game device receives said stop request and in a manner visually associating said match card with said in-hand card consistent with said bonus winning amount.

33. The game device of claim 28 where said associating said match card with said in-hand card further comprises means for showing a moveable element on a screen visible to said player having a first end and a second end connected by a visible connector portion, where said first end is in visual association with said match card and said second end and said connector portion move on said screen and then stop moving such that said second end is in visible association with said in-hand card.

34. The game device of claim 33 where said means for associating said match card with said in-hand card further comprises having means for allowing said player to interactively enter a stop request after said second end is moving and before said second end stops moving, and where said second end further stops moving as quickly as possible after said game device receives said stop request and in a manner visually associating said second end with said in-hand card consistent with said bonus winning amount.

35. The game device of claim 28 where means for associating said match card with said in-hand card further comprises means for creating a same visual change to both said match card and said in-hand card where said visual change comprising one of: a color-based change; an intensity-based change; a hue-based change; or, a combination of color, hue and intensity change.

36. The game device of claim 35 where said means for associating said match card with said in-hand card further comprises means for allowing said player to interactively enter a stop request after said visual change is shown with said match card and while a similar visual change is being applied to said in-hand cards, one at a time and moving from one in-hand card to another, before said visual changes stop, and where said visual changes stop as quickly as possible after said game device receives said stop request and in a manner where said visually changed in-hand card and said same visually changed match card are consistent with said bonus winning amount.

37. The game device of claim 28 where said means for associating said match card with said in-hand card further comprises means for positioning, in a fixed manner, said match card in a position that is one of: visually above; or, visually near, said in-hand card.

38. The game device of claim 37 where said means for associated said match card with said in-hand card further comprises means for having a static visual connector between said cards, where the visual connector is one of: an arrow; or, a line.

* * * * *